US011308828B2

(12) United States Patent
Wang

(10) Patent No.: US 11,308,828 B2
(45) Date of Patent: Apr. 19, 2022

(54) DISPLAY PANEL, DISPLAY MODULE AND DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventor: Haifeng Wang, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 160 days.

(21) Appl. No.: 16/770,599

(22) PCT Filed: Dec. 3, 2019

(86) PCT No.: PCT/CN2019/122693
§ 371 (c)(1),
(2) Date: Jun. 6, 2020

(87) PCT Pub. No.: WO2021/022735
PCT Pub. Date: Feb. 11, 2021

(65) Prior Publication Data

US 2021/0407340 A1 Dec. 30, 2021

(30) Foreign Application Priority Data

Aug. 8, 2019 (CN) ..... 201910730401.5

(51) Int. Cl.
*G09F 9/30* (2006.01)

(52) U.S. Cl.
CPC ..... *G09F 9/301* (2013.01)

(58) Field of Classification Search
CPC ..... G09F 9/301
See application file for complete search history.

(56) References Cited

U.S. PATENT DOCUMENTS

| | | | | |
|---|---|---|---|---|
| 11,011,729 | B2 * | 5/2021 | Wang | H01L 51/0097 |
| 2003/0086050 | A1 * | 5/2003 | Lee | G02F 1/1341 349/153 |
| 2014/0147966 | A1 * | 5/2014 | Nakagawa | H01L 29/66969 438/104 |

(Continued)

FOREIGN PATENT DOCUMENTS

| | | | |
|---|---|---|---|
| CN | 106410029 A | | 2/2017 |
| CN | 206003771 U | * | 3/2017 |

(Continued)

*Primary Examiner* — Joe H Cheng
(74) *Attorney, Agent, or Firm* — Dickinson Wright PLLC

(57) ABSTRACT

The present application provides a display panel, a display module and a display device. In a non-display region of the display panel, exhaust holes are disposed inside arranging areas of alignment terminals. When attaching a support film in the non-display region, the exhaust holes serve as gas discharge channels to exhaust the gas located in the arranging areas of the alignment terminals and located between the support film and the display panel, thereby alleviating the problem of bubbles between the display panel and the support film in existing flexible displays.

20 Claims, 4 Drawing Sheets

(56) References Cited

U.S. PATENT DOCUMENTS

| | | | | |
|---|---|---|---|---|
| 2016/0202516 | A1* | 7/2016 | Watanabe | G02F 1/1339 349/130 |
| 2017/0090661 | A1* | 3/2017 | Kim | H01L 27/3276 |
| 2017/0222165 | A1 | 8/2017 | Liu et al. | |

FOREIGN PATENT DOCUMENTS

| | | | | | |
|---|---|---|---|---|---|
| CN | 206003771 | U | | 3/2017 | |
| CN | 108346379 | A | * | 7/2018 | |
| CN | 108346379 | A | | 7/2018 | |
| CN | 108831303 | A | * | 11/2018 | |
| CN | 108831303 | A | | 11/2018 | |
| CN | 109377877 | A | * | 2/2019 | G06F 1/1652 |
| CN | 109377877 | A | | 2/2019 | |
| CN | 111474756 | A | * | 7/2020 | |

* cited by examiner

DISPLAY PANEL, DISPLAY MODULE AND DISPLAY DEVICE

This application is the National Stage of PCT/CN2019/122693 filed on Dec. 3, 2019, which claims priority under 35 U.S.C. § 119 of Chinese Application No. 201910730401.5 filed on Aug. 8, 2019, the disclosure of which is incorporated by reference.

FIELD OF THE DISCLOSURE

The present application relates to display technologies, and more particularly to a display panel, a display module and a display device.

DESCRIPTION OF RELATED ARTS

In existing flexible displays, a flexible substrate after peeling off a glass substrate is very soft. In order to better protect and support the flexible substrate in subsequent processes, it has to have the flexible substrate to be attached to a support film with a certain degree of rigidity.

However, since film layers in a display region and a non-display region of a display panel are different from each other, the display panel cannot be well supported in the non-display region during attaching to the support film. This causes bubbles generated between the display panel and the support film, thereby affecting performance of the display products.

Therefore, the existing flexible displays have a problem of bubbles between the display panel and the support film, which needs to be solved.

Technical Problems

The present application provides a display panel, a display module and a display device, for alleviating the problem of bubbles between the display panel and a support film in existing flexible displays.

Technical Solutions

To solve above problems, the technical solutions provided in the present application are described below.

The present application provides a display panel, wherein in a non-display region, the display panel includes:

alignment terminals; and exhaust holes, formed inside arranging areas of the alignment terminals and penetrating the display panel, configured to exhaust bubbles generated when attaching the display panel to a support film.

In the display panel provided in the present application, the exhaust holes are disposed in locations where the alignment terminals are located.

In the display panel provided in the present application, only one exhaust hole is disposed in a location where one alignment terminal is located.

In the display panel provided in the present application, the exhaust hole is located at a center of the alignment terminal.

In the display panel provided in the present application, at least two exhaust holes are disposed in a location where one alignment terminal is located.

In the display panel provided in the present application, the exhaust holes are distributed uniformly in the location where the alignment terminal is located.

In the display panel provided in the present application, the exhaust holes are same in size and shape.

In the display panel provided in the present application, at least one of the exhaust holes is different from other exhaust holes in size, or at least one of the exhaust holes is different from other exhaust holes in shape.

In the display panel provided in the present application, an area of the exhaust hole occupies 30% to 60% of an area of the alignment terminal.

In the display panel provided in the present application, the exhaust hole is shaped as one or more of a circle, a quadrilateral and a cross.

The present application provides a display module, including:

the display panel according to any of the afore-described embodiments, the display panel including alignment terminals and first exhaust holes in a non-display region, the first exhaust holes formed inside arranging areas of the alignment terminals and penetrating the display panel, the first exhaust holes configured to exhaust bubbles generated when attaching the display panel to a support film; and the support film, configured to support the display panel, including a first support film located in a display region and a second support film located in the non-display region.

In the display module provided in the present application, a plurality of second exhaust holes are disposed on the second support film, and the second exhaust holes are configured to exhaust bubbles generated when attaching the display panel to the second support film.

In the display module provided in the present application, a density of the second exhaust holes corresponding to the arranging areas of the alignment terminals is greater than a density of the second exhaust holes corresponding to other areas.

In the display module provided in the present application, the second exhaust holes are distributed uniformly over the second support film.

In the display module provided in the present application, the second exhaust holes are same in size and shape.

In the display module provided in the present application, the second exhaust holes and the first exhaust holes have a same shape, and the second exhaust holes and the first exhaust holes have a same size.

In the display module provided in the present application, the second exhaust holes and the first exhaust holes have different shapes, or the second exhaust holes and the first exhaust holes have different sizes.

In the display module provided in the present application, at least one of the second exhaust holes is different from other second exhaust holes in size, or at least one of the second exhaust holes is different from other second exhaust holes in shape.

In the display module provided in the present application, the second exhaust holes are shaped as one or more of a circle, a quadrilateral and a cross.

Meanwhile, the present application provides a display device including the display module according to any of the afore-described embodiments. The display module includes:

a display panel, including alignment terminals and first exhaust holes in a non-display region, the first exhaust holes formed inside arranging areas of the alignment terminals and penetrating the display panel, the first exhaust holes configured to exhaust bubbles generated when attaching the display panel to a support film; and the support film, configured to support the display panel, including a first support film located in a display region and a second support film located in the non-display region.

Beneficial Effects

The present application provides a display panel, a display module and a display device. The display panel includes alignment terminals and first exhaust holes in a non-display region. The exhaust holes are formed inside arranging areas of the alignment terminals and penetrates the display panel. The exhaust holes are configured to exhaust bubbles generated when attaching the display panel to a support film. In the non-display region of the display panel, the exhaust holes are disposed inside the arranging areas of the alignment terminals. When attaching the support film in the non-display region of the display panel, the exhaust holes serve as gas discharge channels to exhaust the gas located inside the arranging areas of the alignment terminals and located between the support film and the display panel, thereby alleviating the problem of bubbles between the display panel and the support film in existing flexible displays, ensuring that there is no gas located inside the arranging areas of the alignment terminals and located between the display panel and the support film, avoiding malfunction of identification on the alignment terminals in subsequent processes due to existence of the bubbles between the display panel and the support film.

DESCRIPTION OF DRAWINGS

FIG. 3(*b*) is a first locally cross-sectional view of the display panel along A-A' provided in an embodiment of the present application.

FIG. 4(*b*) is a second locally cross-sectional view of the display panel along B-B' provided in an embodiment of the present application.

FIG. 5(*b*) is a third locally cross-sectional view of the display panel along C-C' provided in an embodiment of the present application.

FIG. 6(*b*) is a fourth locally cross-sectional view of the display panel along D-D' provided in an embodiment of the present application.

DESCRIPTION OF EMBODIMENTS OF THE DISCLOSURE

Figure 1:
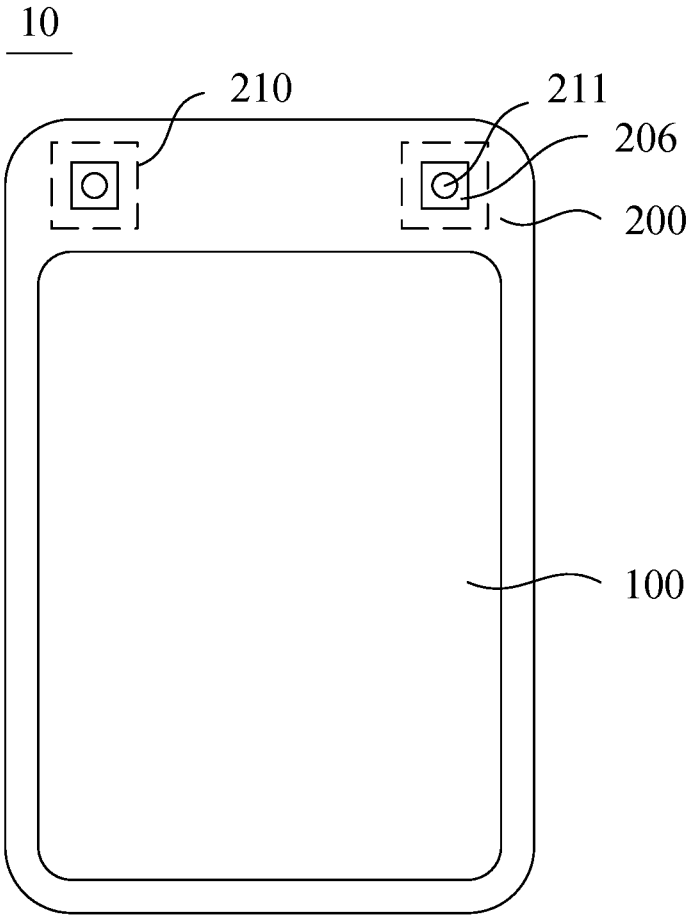
FIG. 1 is a top view of a display panel provided in an embodiment of the present application.

The following descriptions for the respective embodiments are specific embodiments capable of being implemented for illustrations of the present application with referring to the appended figures. In describing the present application, spatially relative terms such as "upper", "lower", "front", "back", "left", "right", "inner", "outer", "lateral", and the like, may be used herein for ease of description as illustrated in the figures. Therefore, the spatially relative terms used herein are intended to illustrate the present application for ease of understanding, but are not intended to limit the present application. In the appended figures, units with similar structures are indicated by same reference numbers.

Flexible displays are bendable display devices manufactured using flexible substrates. Generally, a flexible substrate, a material of which is polyimide (PI) or polyethylene terephthalate (PET) for example, is prepared on the surface of a rigid glass substrate. Then, thin-film transistors (TFTs) and light-emitting functional film layers are fabricated on the flexible substrate. Finally, the rigid glass substrate is peeled and removed by using laser lift off (LLO) or mechanical lift off (MLO). Because the flexible substrate after peeling off the glass substrate is thin, lacks stiffness, and easily deforms, the use and life of the flexible display is affected. In order to improve the strength of the flexible substrate, it is necessary to attach a support film having sufficient stiffness to the flexible substrate on the bottom of the flexible substrate. The support film is a sheet-like film made of an organic polymer material, and is attached to the flexible substrate through an optical clear adhesive (OCA) or a pressure-sensitive adhesive (PSA).

In attaching the support film, a general process is that a display module is turned upside down and then placed on a hard platform, the support film is attached to the flexible substrate, and then bubbles between the support film and the display panel are discharged by a rolling process, such that the supporting film is closely attached to the display panel. However, since integrated circuits in the non-display region of the display panel are usually made of a material such as silicon (Si), gallium arsenide (GaAs), and silicon carbide (SiC), the pressure they can withstand is small. When they are subjected to a local force and the force exceeds a bearing limit, dangerous cases such as breakage and damage of them are likely to occur, thereby affecting performance of the circuits and further affecting a normal display function of the flexible display device. In addition, film layer structures in the display region and the non-display region are different from each other, and there is a height difference between the film layer structures in the display region and the non-display region.

Therefore, in attaching the support film, it cannot use the rigid platform as a support for the non-display region, and it also cannot use the rolling process to remove the bubbles between the display panel and the support film. The attachment between the display panel and the support film can only be achieved by inertial attaching. Accordingly, after the attaching of the support film is completed, bubbles will exist between the display panel and the support film in the non-display region. The bubbles between the display panel and the support film, especially the bubbles located in the areas where the alignment terminals are located, will cause malfunction of identification on the alignment terminals during an alignment process using the alignment terminals in a profile cutting process and subsequent adhering process, thereby affecting manufacture of the displays.

Based on this, the present application provides a display panel, which can alleviate the problem of bubbles between the display panel and the support film in existing flexible displays.

In an embodiment, as shown in FIG. 1, the display panel 10 provided in the present application includes the following in a non-display region 200:

alignment terminals 206; and exhaust holes 211, formed inside arranging areas 210 of the alignment terminals and penetrating the display panel 10, configured to exhaust bubbles generated when attaching the display panel 10 to a support film.

The embodiment of the present application provides a display panel. In the non-display region of the display panel, the exhaust holes are disposed inside the arranging areas of the alignment terminals. When attaching the support film in the non-display region, the exhaust holes serve as gas discharge channels to exhaust the gas located inside the arranging areas of the alignment terminals and located between the support film and the display panel, thereby alleviating the problem of bubbles between the display panel and the support film in existing flexible displays, ensuring that there is no gas located inside the arranging areas of the alignment terminals and located between the display panel and the support film, avoiding malfunction of identification on the alignment terminals in subsequent processes due to existence of the bubbles between the display panel and the support film.

In an embodiment, the display panel provided in the present application is an organic light emitting diode (OLED) display panel. The display panel provided in the present application will be further illustrated by taking the OLED display panel for example. The OLED display panel is used to illustrate the display panel provided in the present application, and the present application is not limited thereto. The display panel provided in the present application can also be implemented by other types of display panels.

As shown in FIG. 1, the OLED display panel 10 includes a display region 100 and a non-display region 200. In the non-display region 200, the display panel 10 is further provided with the alignment terminals 201 and the exhaust holes 202 located in the areas 210 for disposing the alignment terminals. The exhaust holes 211 penetrate the display panel 10 and are configured to discharge bubbles generated when attaching the display panel 10 to the support film.

Figure 2:
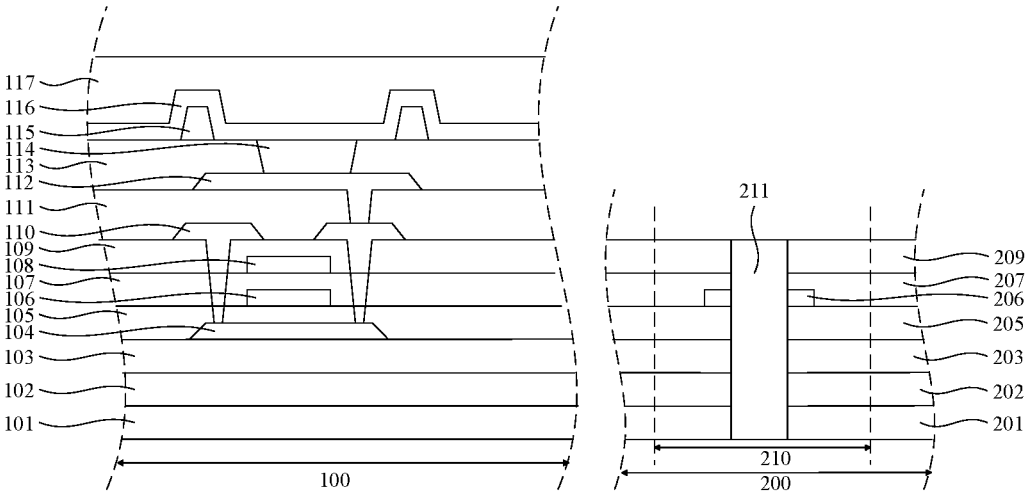
FIG. 2 is a structural schematic diagram illustrating a display panel provided in an embodiment of the present application.

As shown in FIG. 2, in the display region 100, the display panel 10 includes a flexible substrate 101, a barrier layer 102, a buffer layer 103, an active layer 104, a first gate insulating layer 105, a first gate electrode layer 106, a second gate insulating layer 107, a second gate electrode layer 108, an insulating interlayer 109, a source drain electrode layer 110, a passivation layer 111, a pixel electrode layer 112, a pixel definition layer 113, a luminescent material layer 114, supporting posts 115, a common electrode layer 116 and an encapsulating layer 117 that are sequentially laminated from bottom to top.

In the non-display region 200, the display panel 10 includes a flexible substrate 201, a barrier layer 202, a buffer layer 203, a first gate insulating layer 205, alignment terminals 206, a second gate insulating layer 207 and an insulating interlayer 109. The arranging areas 210 of the alignment terminals are within the non-display region 200. The arranging areas 210 of the alignment terminals are smaller than the non-display region 200 of the display panel. The alignment terminals 211 are formed in the arranging areas 210 of the alignment terminals. The exhaust holes 211 are disposed inside the arranging areas 210 of the alignment terminals. The exhaust holes 211 penetrate the display panel 10.

The flexible substrate 101 and the flexible substrate 201 are a same substrate. The barrier layer 102 and the barrier layer 202 are a same barrier layer. The buffer layer 103 and the buffer layer 203 are a same buffer layer. The first gate insulating layer 105 and the first gate insulating layer 205 are a same gate insulating layer. The first gate electrode layer 106 and the first gate electrode layer 206 are a same gate electrode layer. The second gate insulating layer 107 and the second gate insulating layer 207 are a same gate insulating layer. The insulating interlayer 109 and the insulating interlayer 209 are a same insulating interlayer. The pattern of the first gate electrode layer 106 forms first gate electrodes located in the display region 100 and the alignment terminals 206 located in the non-display region 200.

When different approaches to dispose the exhaust holes 211 in the areas 210 for arranging the alignment terminals are used, it will yield different effects of discharging the bubbles generated when attaching the display panel 10 to the support film and the ways to identify the alignment terminals 211 in subsequent processes will be different as well.

Figure 3:
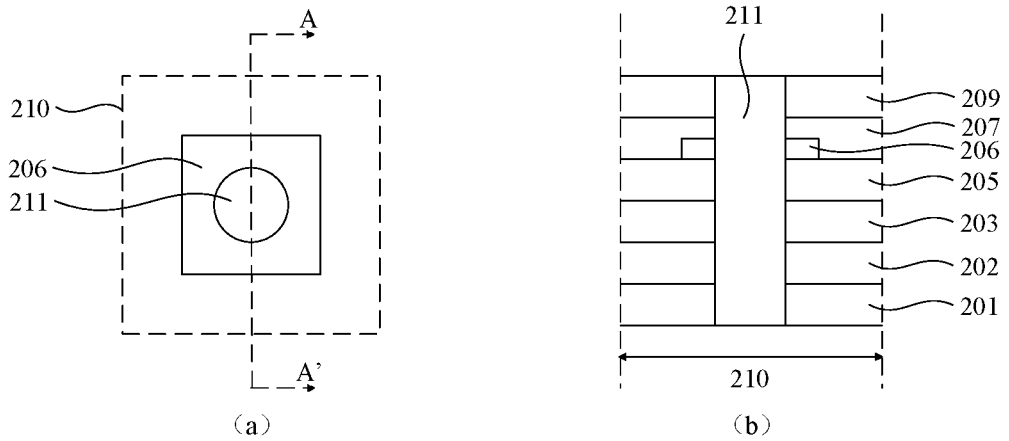
FIG. 3(*a*) is a first locally enlarged view of the display panel provided in an embodiment of the present application.

In an embodiment, as shown in FIG. 3, the exhaust holes 211 are disposed in the locations where the alignment terminals 206 are located, and only one exhaust hole 211 is disposed in an area where one alignment terminal 206 is located.

In the present embodiment, the exhaust hole 211 can be disposed at a center of the alignment terminal 206. The exhaust hole 21 can also be disposed at an edge of the alignment terminal 206, or at any other position in the locations where the alignment terminal 206 is located, and the present application is not limited thereto.

In the present embodiment, the exhaust hole 211 can be shaped as a circle, a quadrilateral, or any one of a cross and any arbitrary shape, and the present application is not limited thereto.

In the present embodiment, the exhaust holes 211 located in different locations where the alignment terminals are located may be completely same in size and shape, and may also be different in at least one of the two features—size and shape, and the present application is not limited thereto.

Since the alignment terminals 206 play a role of alignment identification in entire display panel manufacturing process, the identification can be accurately carried out only when the areas occupied by metal material of the alignment terminals 206 are sufficiently large. Accordingly, the areas occupied by the exhaust holes 211 need to be controlled to be within a certain range. If the areas of the exhaust holes 211 are too large, it will cause a decrease of metal areas of the alignment terminals and it is not beneficial for the identification on the alignment terminals in subsequent processes. If the areas of the exhaust holes are too small, it cannot effectively discharge the gas generated when attaching the display panel to the support film. In consideration of above factors, an area of the exhaust hole 211 occupies 30% to 60% of an area of the alignment terminal 206 corresponding to the exhaust hole 211.

In the present embodiment, one exhaust hole is disposed in a location where an alignment terminal is located. When attaching the display panel to the support film, the exhaust hole serves as a discharge channel to exhaust bubbles located between the display panel and the support film and in the arranging area of the alignment terminal. In such a way, it is alleviated that the problem of bubbles between the display panel and the support film in existing flexible displays. It is ensured that after the attaching, no gas is generated between the display panel and the support film in the location where the alignment terminal is located. It is avoided malfunction of identification on the alignment terminal in subsequent processes due to existence of the bubbles.

Figure 4:
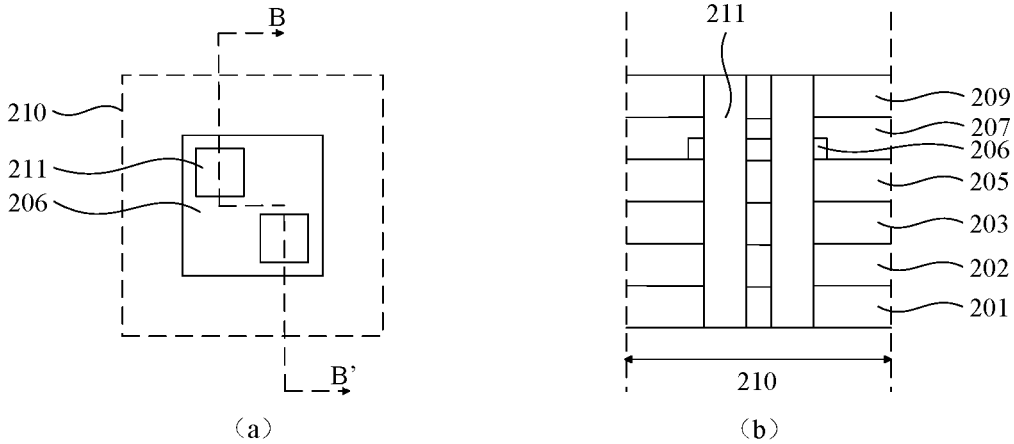
FIG. 4(*a*) is a second locally enlarged view of the display panel provided in an embodiment of the present application.

In an embodiment, as shown in FIG. 4, the exhaust holes 211 are disposed in the locations where the alignment terminals 206 are located, and at least two exhaust holes 211 are disposed in the location where one alignment terminal 206 is located.

In the present embodiment, the exhaust holes 211 are distributed uniformly in the location where the alignment terminal 206 is located, distributed symmetrically in the location, or any arbitrary distribution may be applied, and the present application is not limited thereto.

In the present embodiment, the exhaust holes 211 can be shaped as a circle, a quadrilateral, or any one of a cross and any arbitrary shape. The exhaust holes 211 located in a same location where the alignment terminal 206 is located may be completely same in size and shape. It is also applicable that there are at least two exhaust holes 211 which are different in at least one of the two features—size and shape.

In the present embodiment, the exhaust holes 211 located in different locations where the alignment terminals are located may be completely same in arrangement. It is also applicable that there are at least two alignment terminals 206, in the locations of which the exhaust holes 211 are different in arrangement, and the present application is not limited thereto.

Since the alignment terminals 206 play a role of alignment identification in entire display panel manufacturing process, the identification can be accurately carried out only when the areas occupied by metal material of the alignment terminals 206 are sufficiently large. Accordingly, the areas occupied by the exhaust holes 211 need to be controlled to be within a certain range. If the areas of the exhaust holes 211 are too large, it will cause a decrease of metal areas of the alignment terminals and it is not beneficial for the identification on the alignment terminals in subsequent processes. If the areas of the exhaust holes are too small, it cannot effectively discharge the gas generated when attaching the display panel to the support film. The areas of the exhaust holes 211 occupy 30% to 60% of an area of the alignment terminal 206 corresponding to the exhaust holes 211.

In the present embodiment, a plurality of exhaust holes are disposed in a location of an alignment terminal. When attaching the display panel to the support film, the plurality of exhaust holes simultaneously serve as discharge channels to exhaust bubbles located between the display panel and the support film and in the area where the alignment terminal is arranged. In such a way, it is alleviated that the problem of bubbles between the display panel and the support film in existing flexible displays. It is ensured that after the attaching, no gas is generated between the display panel and the support film in the location where the alignment terminal is located. It is avoided malfunction of identification on the alignment terminal in subsequent processes due to existence of the bubbles.

Figure 5:
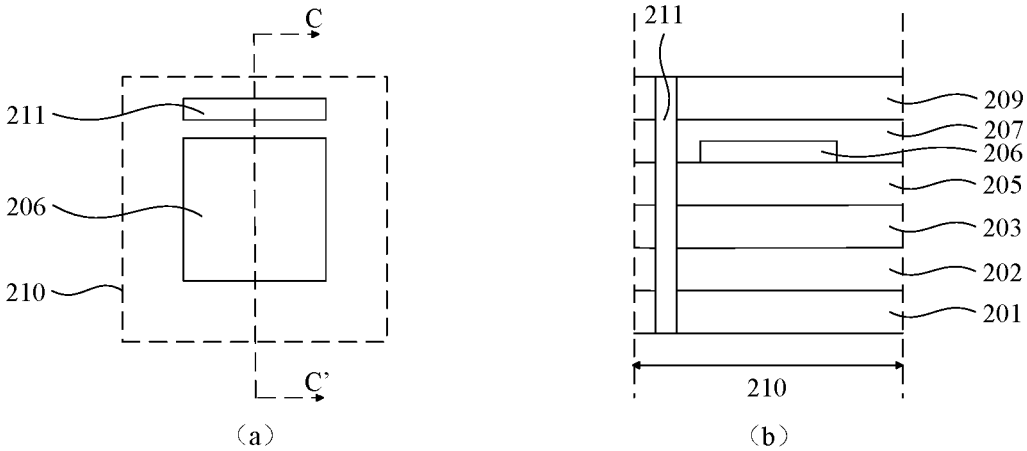
FIG. 5(*a*) is a third locally enlarged view of the display panel provided in an embodiment of the present application.

In an embodiment, as shown in FIG. 5, an exhaust hole 211 is disposed inside an arranging area 210 of an alignment terminal and beyond a location where the alignment terminal is located, and only one exhaust hole 211 is disposed in the arranging area 210 of one alignment terminal.

In the present embodiment, the exhaust hole 211 can be disposed at an edge of the alignment terminal 206 and can also be disposed at two edges of the alignment terminal 206 or at any arbitrary position, and the present application is not limited thereto.

In the present embodiment, the exhaust hole 211 can be shaped as a circle, a quadrilateral, or any one of an L shape and any arbitrary shape, and the present application is not limited thereto.

In the present embodiment, the exhaust holes 211 located in different arranging areas of the alignment terminals may be completely same in size and shape, and may also be different in at least one of the two features—size and shape, and the present application is not limited thereto.

In the present embodiment, one exhaust hole is disposed inside an arranging area of an alignment terminal and beyond a location where the alignment terminal is located. When attaching the display panel to the support film, the exhaust hole serves as a discharge channel to exhaust bubbles located between the display panel and the support film and located in the arranging area of the alignment terminal. In such a way, it is alleviated that the problem of bubbles between the display panel and the support film in existing flexible displays. It is ensured that after the attaching, no gas is generated between the display panel and the support film in the location where the alignment terminal is located. It is avoided malfunction of identification on the alignment terminal in subsequent processes due to existence of the bubbles. Meanwhile, in the present embodiment, the exhaust hole is disposed beyond the location where the alignment terminal is located without occupying the area of the alignment terminal. It is ensured an effective area of the alignment terminal, thereby guaranteeing accuracy of alignment identification on the alignment terminal in subsequent processes.

Figure 6:
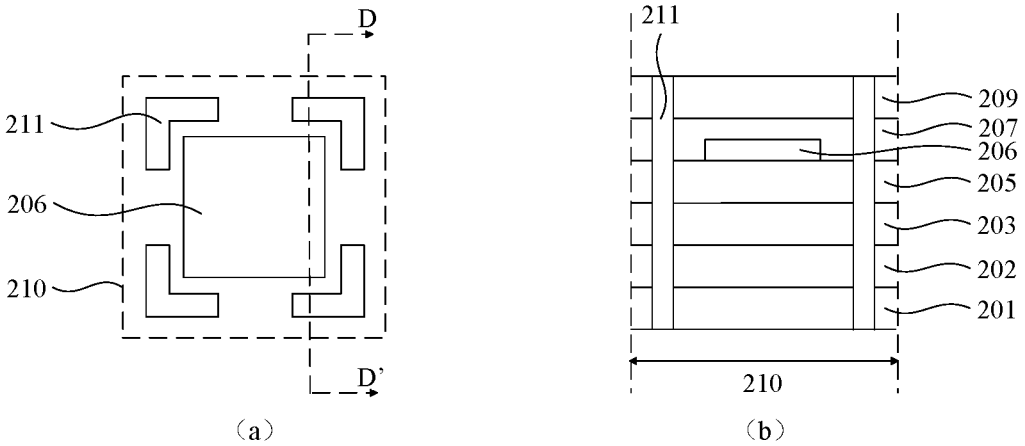
FIG. 6(*a*) is a fourth locally enlarged view of the display panel provided in an embodiment of the present application.

In an embodiment, as shown in FIG. 6, exhaust holes 211 are disposed inside an arranging area 210 of an alignment terminal and beyond a location where the alignment terminal 206 is located, and at least two exhaust holes 211 are disposed in the arranging area 210 of one alignment terminal.

In the present embodiment, the exhaust holes 211 are within the arranging area 210 of the alignment terminal 206, and can be uniformly disposed, symmetrically disposed or any arbitrary arrangement can be applied, and the present application is not limited thereto.

In the present embodiment, the exhaust holes 211 can be shaped as a circle, a quadrilateral, or any one of an L shape and any arbitrary shape, and the present application is not limited thereto. All the exhaust holes 211 in the arranging area 210 of one alignment terminal may be completely same in size and shape. It is also applicable that there are at least two exhaust holes 211 which are different in at least one of the two features—size and shape.

In the present embodiment, the exhaust holes 211 located in different arranging areas 210 of the alignment terminals may be completely same in arrangement. It is also applicable that there are at least two arranging areas 210 of the alignment terminals, in which the exhaust holes 211 are different in arrangement, and the present application is not limited thereto.

In the present embodiment, at least two exhaust holes are disposed inside an arranging area of an alignment terminal and beyond a location where the alignment terminal is located. When attaching the display panel to the support film, a plurality of exhaust holes serve as discharge channels to exhaust bubbles located between the display panel and the support film and located in the arranging area of the alignment terminal. In such a way, it is alleviated that the problem of bubbles between the display panel and the support film in existing flexible displays. It is ensured that after the attaching, no gas is generated between the display panel and the support film in the location where the alignment terminal is located. It is avoided malfunction of identification on the alignment terminal in subsequent processes due to existence of the bubbles. Meanwhile, in the present embodiment, the exhaust hole is disposed beyond the location where the alignment terminal is located without occupying the area of the alignment terminal. It is ensured an effective area of the alignment terminal, thereby guaranteeing accuracy of alignment identification on the alignment terminal in subsequent processes.

An embodiment of the present application provides a display module, including:

a display panel, including alignment terminals and first exhaust holes in a non-display region, the first exhaust holes formed inside arranging areas of the alignment terminals and penetrating the display panel, the first exhaust holes configured to exhaust bubbles generated when attaching the display panel to a support film; and the support film, configured to support the display panel, including a first support film located in a display region and a second support film located in the non-display region.

The embodiment of the present application provides a display module including a display panel and a support film. In the non-display region of the display panel, the first exhaust holes are disposed inside the arranging areas of the alignment terminals. When attaching the support film in the non-display region of the display panel, the first exhaust holes serve as gas discharge channels to exhaust the gas located inside the arranging areas of the alignment terminals and located between the support film and the display panel, thereby alleviating the problem of bubbles between the display panel and the support film in existing flexible displays, ensuring that there is no gas located inside the arranging areas of the alignment terminals and located between the display panel and the support film, avoiding malfunction of identification on the alignment terminals in subsequent processes due to existence of the bubbles between the display panel and the support film.

Figure 7:
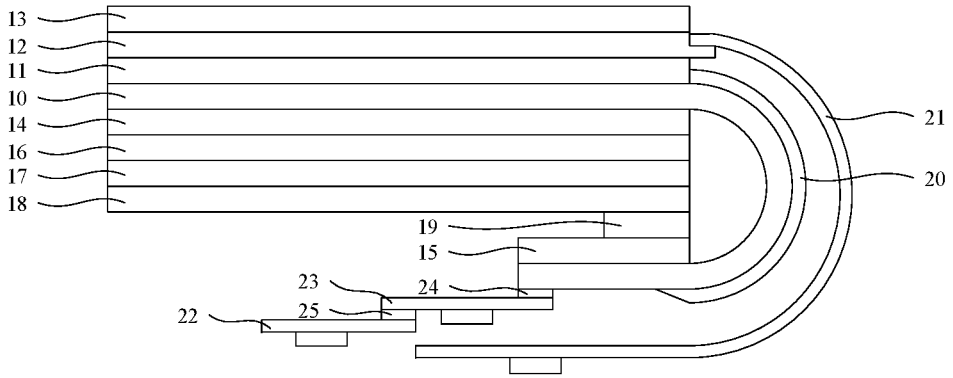
FIG. 7 is a structural schematic diagram illustrating a display module provided in an embodiment of the present application.

In an instance, as shown in FIG. 7, the display module provided in the present application includes:

a display panel 10, which is a display panel according to any of the afore-described embodiments, the display panel 10 further including a flat display region on the top, an arc bending region and a bonding region bended below the display region;

a touch layer 12 and a polarization plate 13 which are attached on the display region of the display panel 10 by an optical adhesive layer 11, the polarization plate 13 disposed on the touch layer 12;

a support film attached to the display panel 10 and configured to support the display panel 10, including a first support film 14 located in the display region of the display panel 10 and a second support film 15 located in a non-display region of the display panel 10;

a foam layer 16, a graphite layer 17 and a copper layer 18 that are attached beneath the display panel 10, the graphite layer 17 disposed below the foam layer 16, the copper layer 18 disposed below the graphite layer 17, wherein the foam layer 16, the graphite layer 17 and the copper layer 18 are cooperated to support the display panel 10 and play a role of heat dissipation for the display panel 10;

a reinforced plate 19 for attaching the copper layer 18 to the bonding region of the display panel 10;

a reinforced film 20 attached on the bending region of the display panel 10, configured to support and protect the bending region of the display panel 10, a thickness of which and be designed as needed for adjusting the curvature and a concentrated position of stress of the bending region of the display panel 10;

a first flexible circuit board 21, connected to the touch layer 12; and a second flexible circuit board 22, connected to the bonding region of the display panel 10 via a flip-chip thin film 23, one end of the flip-chip thin film 23 bonding to the bonding region of the display panel 10 via a first anisotropy conductive adhesive 24, the other end of the flip-chip thin film 23 bonding to the second flexible circuit board 22 via a second anisotropy conductive adhesive 25.

A plurality of second exhaust holes are disposed on the second support film 15 and are configured to discharge bubbles generated when attaching the display panel 10 to the second support film.

When different approaches to dispose the second exhaust holes on the second support film 15 are used, it will yield different effects of discharging the bubbles generated when attaching the display panel 10 to the second support film 15.

Figure 8:
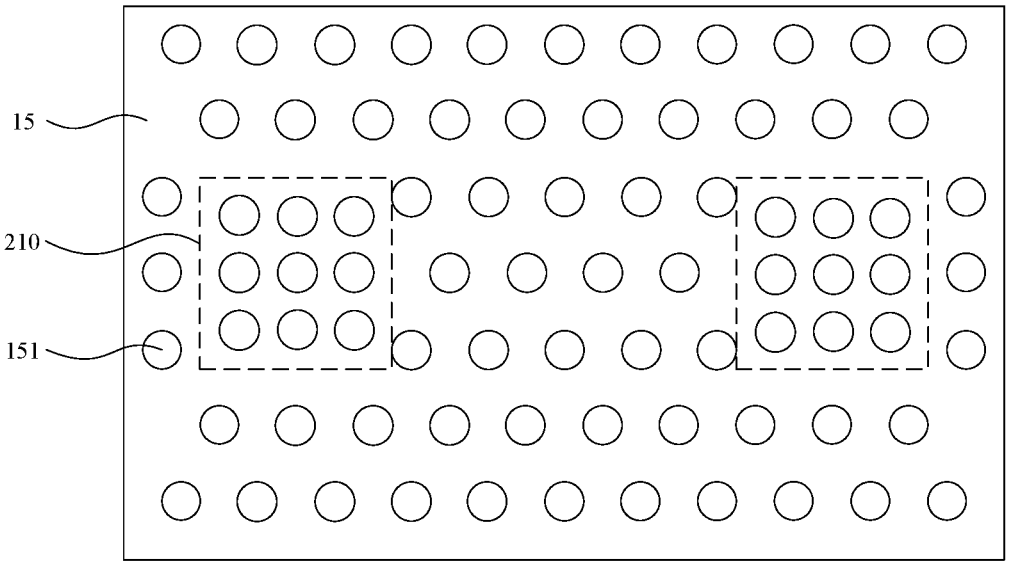
FIG. 8 is a first top view of a second support film provided in an embodiment of the present application.

In an embodiment, as shown in FIG. 8, a density of the second exhaust holes 151, on the second support film 15, corresponding to the arranging areas 210 of the alignment terminals is greater than a density of the second exhaust holes 151 corresponding to other areas on the second support film, and the density can be designed according to practical applications and actual needs, and the present application is not limited thereto.

In the present embodiment, the second exhaust holes 151 can be arranged in a matrix, in a misaligned manner, or any arbitrary arrangement is also applicable, and the present application is not limited thereto.

In the present embodiment, the second exhaust holes 211 can be shaped as a circle, a quadrilateral, or a cross, or any arbitrary shape, and the present application is not limited thereto.

In an embodiment, all the second exhaust holes 151 located on the second support film 15 are completely same in size and shape. The second exhaust holes 15 and the first exhaust holes may be completely same in shape and size, and may also be different in at least one of two features—shape and size.

In another embodiment, there are at least two exhaust holes 151, which are different in at least one of two features—shape and size.

In the present embodiment, a plurality of second exhaust holes are disposed on the second support film. When attaching the support film to the display panel, the second exhaust holes serve as gas discharging channels to exhaust gas between the display panel and the second support film, thereby reducing the chances to generate bubbles between the display panel and the second support film. It is more beneficial to adhere the display panel to the second support film. Meanwhile, a density of the second exhaust holes corresponding to the arranging area of the alignment terminal is greater than a density of the second exhaust holes in other areas on the second support film. This increases a room to exhaust the gas located in the arranging area of the alignment terminal and between the display panel and the second support film. It is ensured that after the attaching, no gas is generated between the display panel and the support film in the location where the alignment terminal is located. It is avoided malfunction of identification on the alignment terminal in subsequent processes due to existence of the bubbles.

Figure 9:
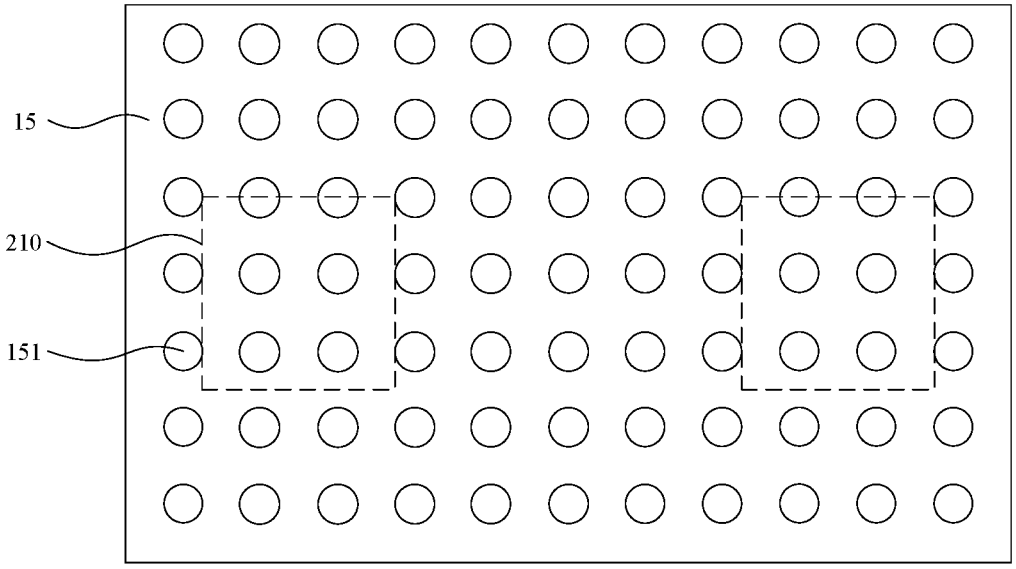
FIG. 9 is a second top view of a second support film provided in an embodiment of the present application.

In an embodiment, as shown in FIG. 9, the second exhaust holes 151 are distributed uniformly over the second support film 15. A density of the second exhaust holes can be designed according to practical applications and actual needs, and the present application is not limited thereto.

In the present embodiment, the second exhaust holes 151 can be arranged in a matrix, in a misaligned manner, or any arbitrary arrangement is also applicable, and the present application is not limited thereto.

In the present embodiment, the second exhaust holes 211 can be shaped as a circle, a quadrilateral, or a cross, or any arbitrary shape, and the present application is not limited thereto.

In an embodiment, all the second exhaust holes 151 located on the second support film 15 are completely same in size and shape. The second exhaust holes 15 and the first exhaust holes may be completely same in shape and size, and may also be different in at least one of two features—shape and size.

In another embodiment, there are at least two exhaust holes 151, which are different in at least one of two features—shape and size.

In the present embodiment, a plurality of second exhaust holes are disposed on the second support film. When attaching the support film to the display panel, the second exhaust holes serve as gas discharging channels to exhaust gas between the display panel and the second support film, thereby reducing the chances to generate bubbles between the display panel and the second support film. It is more beneficial to adhere the display panel to the second support film. Meanwhile, a room increases so as to exhaust the gas located in the arranging area of the alignment terminal and between the display panel and the second support film. It is ensured that after the attaching, no gas is generated between the display panel and the support film in the location where the alignment terminal is located. It is avoided malfunction of identification on the alignment terminal in subsequent processes due to existence of the bubbles.

An embodiment of the present application further provides a display device, which includes a display module according to any of the afore-described embodiments. The display module includes:

a display panel, including alignment terminals and first exhaust holes in a non-display region, the first exhaust holes formed inside arranging areas of the alignment terminals and penetrating the display panel, the first exhaust holes configured to exhaust bubbles generated when attaching the display panel to a support film; and the support film, configured to support the display panel, including a first support film located in a display region and a second support film located in the non-display region.

The embodiment of the present application provides a display device including a display module. The display module includes a display panel and a support film. In the non-display region of the display panel, the first exhaust holes are disposed inside the arranging areas of the alignment terminals. When attaching the support film in the non-display region of the display panel, the first exhaust holes serve as gas discharge channels to exhaust the gas located in the locations where the alignment terminals are located and located between the support film and the display panel, thereby alleviating the problem of bubbles between the display panel and the support film in existing flexible displays, ensuring that there is no gas located inside the arranging areas of the alignment terminals and located between the display panel and the support film, avoiding malfunction of identification on the alignment terminals in subsequent processes due to existence of the bubbles between the display panel and the support film.

In an embodiment, the first exhaust holes are disposed in locations where the alignment terminals are located.

In an embodiment, only one first exhaust hole is disposed in a location where one alignment terminal is located.

In an embodiment, the first exhaust hole is located at a center of the alignment terminal.

In an embodiment, at least two first exhaust holes are disposed in a location where one alignment terminal is located.

In an embodiment, the first exhaust holes are distributed uniformly in the location where the alignment terminal is located.

In an embodiment, the first exhaust holes are same in size and shape.

In an embodiment, an area of the first exhaust hole occupies 30% to 60% of an area of the alignment terminal.

In an embodiment, the exhaust hole is shaped as one or more of a circle, a quadrilateral and a cross.

In an embodiment, a plurality of second exhaust holes are disposed on the second support film, and the second exhaust holes are configured to exhaust bubbles generated when attaching the display panel to the second support film.

In an embodiment, a density of the second exhaust holes corresponding to the arranging areas of the alignment terminals is greater than a density of the second exhaust holes corresponding to other areas.

In an embodiment, the second exhaust holes are distributed uniformly over the second support film.

In an embodiment, the second exhaust holes are same in size and shape.

In an embodiment, the second exhaust holes and the first exhaust holes have a same shape, and the second exhaust holes and the first exhaust holes have a same size.

In an embodiment, the second exhaust holes and the first exhaust holes have different shapes, or the second exhaust holes and the first exhaust holes have different sizes.

In an embodiment, at least one of the second exhaust holes is different from other second exhaust holes in size, or at least one of the second exhaust holes is different from other second exhaust holes in shape.

In an embodiment, the second exhaust holes are shaped as one or more of a circle, a quadrilateral and a cross.

It can be known from above embodiments that:

The present application provides a display panel, a display module and a display device. The display panel includes alignment terminals and first exhaust holes in a non-display region. The exhaust holes are formed inside arranging areas of the alignment terminals and penetrates the display panel. The exhaust holes are configured to exhaust bubbles generated when attaching the display panel to a support film. In the non-display region of the display panel, the exhaust holes are disposed inside the arranging areas of the alignment terminals. When attaching the support film in the non-display region of the display panel, the exhaust holes serve as gas discharge channels to exhaust the gas located inside the arranging areas of the alignment terminals and located between the support film and the display panel, thereby alleviating the problem of bubbles between the display panel and the support film in existing flexible displays, ensuring that there is no gas located inside the arranging areas of the alignment terminals and located between the display panel and the support film, avoiding malfunction of identification on the alignment terminals in subsequent processes due to existence of the bubbles between the display panel and the support film.

While the preferred embodiments of the present application have been illustrated and described in detail, various modifications and alterations can be made by persons skilled in this art. The embodiment of the present application is therefore described in an illustrative but not restrictive sense. It is intended that the present application should not be limited to the particular forms as illustrated, and that all modifications and alterations which maintain the spirit and realm of the present application are within the scope as defined in the appended claims.

The invention claimed is:

1. A display panel, wherein in a non-display region, the display panel comprises:

alignment terminals; and exhaust holes, formed inside arranging areas of the alignment terminals and penetrating the display panel, configured to exhaust bubbles generated when attaching the display panel to a support film.

2. The display panel according to claim 1, wherein the exhaust holes are disposed in locations where the alignment terminals are located.

3. The display panel according to claim 2, wherein only one exhaust hole is disposed in a location where one alignment terminal is located.

4. The display panel according to claim 3, wherein the exhaust hole is located at a center of the alignment terminal.

5. The display panel according to claim 2, wherein at least two exhaust holes are disposed in a location where one alignment terminal is located.

6. The display panel according to claim 5, wherein the exhaust holes are distributed uniformly in the location where the alignment terminal is located.

7. The display panel according to claim 5, wherein the exhaust holes are same in size and shape.

8. The display panel according to claim 5, wherein at least one of the exhaust holes is different from other exhaust holes in size, or at least one of the exhaust holes is different from other exhaust holes in shape.

9. The display panel according to claim 2, wherein an area of the exhaust hole occupies 30% to 60% of an area of the alignment terminal.

10. The display panel according to claim 1, wherein the exhaust hole is shaped as one or more of a circle, a quadrilateral and a cross.

11. A display module, comprising:

a display panel comprising alignment terminals and first exhaust holes in a non-display region, the first exhaust holes formed inside arranging areas of the alignment terminals and penetrating the display panel, the first exhaust holes configured to exhaust bubbles generated when attaching the display panel to a support film; and the support film, configured to support the display panel, comprising a first support film located in a display region and a second support film located in the non-display region.

12. The display module according to claim 11, wherein a plurality of second exhaust holes are disposed on the second support film, and the second exhaust holes are configured to exhaust bubbles generated when attaching the display panel to the second support film.

13. The display module according to claim 12, wherein a density of the second exhaust holes corresponding to the arranging areas of the alignment terminals is greater than a density of the second exhaust holes corresponding to other areas.

14. The display module according to claim 12, wherein the second exhaust holes are distributed uniformly over the second support film.

15. The display module according to claim 12, wherein the second exhaust holes are same in size and shape.

16. The display module according to claim 15, wherein the second exhaust holes and the first exhaust holes have a same shape, and the second exhaust holes and the first exhaust holes have a same size.

17. The display module according to claim 15, wherein the second exhaust holes and the first exhaust holes have different shapes, or the second exhaust holes and the first exhaust holes have different sizes.

18. The display module according to claim 11, wherein at least one of the second exhaust holes is different from other second exhaust holes in size, or at least one of the second exhaust holes is different from other second exhaust holes in shape.

19. The display module according to claim 11, wherein the second exhaust holes are shaped as one or more of a circle, a quadrilateral and a cross.

20. A display device, comprising a display module, the display module comprising:

a display panel, comprising alignment terminals and first exhaust holes in a non-display region, the first exhaust holes formed inside arranging areas of the alignment terminals and penetrating the display panel, the first exhaust holes configured to exhaust bubbles generated when attaching the display panel to a support film; and the support film, configured to support the display panel, comprising a first support film located in a display region and a second support film located in the non-display region.

* * * * *